US011365956B2

(12) United States Patent
Laheyne

(10) Patent No.: US 11,365,956 B2
(45) Date of Patent: Jun. 21, 2022

(54) PIVOT CONNECTION PART FOR A FLYING MACHINE OR FOR A FLYING MACHINE SYSTEM, IN PARTICULAR A MISSILE

(71) Applicant: MBDA France, Le Plessis Robinson (FR)

(72) Inventor: Clyde Laheyne, Le Plessis Robinson (FR)

(73) Assignee: MBDA France, Le Plessis Robinson (FR)

( * ) Notice: Subject to any disclaimer, the term of this patent is extended or adjusted under 35 U.S.C. 154(b) by 404 days.

(21) Appl. No.: 16/624,029

(22) PCT Filed: Jun. 6, 2018

(86) PCT No.: PCT/FR2018/000158
§ 371 (c)(1),
(2) Date: Dec. 18, 2019

(87) PCT Pub. No.: WO2019/002704
PCT Pub. Date: Jan. 3, 2019

(65) Prior Publication Data

US 2021/0148684 A1 May 20, 2021

(30) Foreign Application Priority Data

Jun. 26, 2017 (FR) ..... 1700684

(51) Int. Cl.
*F42B 10/16* (2006.01)
*F42B 15/01* (2006.01)

(52) U.S. Cl.
CPC ..... *F42B 10/16* (2013.01); *F42B 15/01* (2013.01)

(58) Field of Classification Search
CPC ..... F42B 10/16; F42B 10/14; F42B 15/01
See application file for complete search history.

(56) References Cited

U.S. PATENT DOCUMENTS 2,440,271 A * 4/1948 Hickman ..... F42B 10/14 244/3.28
2,858,765 A * 11/1958 Startzell ..... F42B 10/16 244/3.29

(Continued)

FOREIGN PATENT DOCUMENTS

DE 4406824 A1 9/1995

OTHER PUBLICATIONS

International Search Report dated Aug. 23, 2018, issued in corresponding International Application No. PCT/FR2018/000158, filed Jun. 6, 2018, 5 pages.

(Continued)

*Primary Examiner* — Brian M O'Hara
(74) *Attorney, Agent, or Firm* — Christensen O'Connor Johnson Kindness PLLC

(57) ABSTRACT

A pivot connection part for a flying machine includes an inner body, an outer body radially surrounding the inner body, and a set of connection elements configured to connect the inner body to the outer body. Breaking the connection elements detaches the inner body from the outer body. A first blocking assembly having a cam and a stop is configured to block relative rotation between the inner and outer bodies in a first rotational direction. A second blocking assembly having a pawl and a resilient stop blade is configured to block relative rotation between the inner and outer bodies in a second rotational direction.

12 Claims, 5 Drawing Sheets

(56) References Cited

U.S. PATENT DOCUMENTS

| | | | | |
|---|---|---|---|---|
| 3,578,796 | A * | 5/1971 | Hagler | F42B 10/64 244/3.29 |
| 4,778,127 | A * | 10/1988 | Duchesneau | F42B 10/16 D22/100 |
| 6,092,264 | A | 7/2000 | Banks | |
| 6,186,443 | B1 | 2/2001 | Shaffer | |

OTHER PUBLICATIONS

Written Opinion of the International Searching Authority dated Aug. 23, 2018, issued in corresponding International Application No. PCT/FR2018/000158, filed Jun. 6, 2018, 7 pages.

Written Opinion of the International Searching Authority dated Aug. 23, 2018, issued in corresponding International Application No. PCT/FR2018/000158, filed Jun. 6, 2018, 10 pages.

International Preliminary Report on Patentability dated Dec. 31, 2019, issued in corresponding International Application No. PCT/FR2018/000158, filed Jun. 6, 2018, 1 page.

* cited by examiner

PIVOT CONNECTION PART FOR A FLYING MACHINE OR FOR A FLYING MACHINE SYSTEM, IN PARTICULAR A MISSILE

The present invention relates to a pivot connection part intended for a flying machine or for a flying machine system. It also relates to a flying machine or a flying machine system provided with such a pivot connection part.

Although not exclusively, the present invention applies more specifically to a weapon system, and in particular to a flying machine such as a missile for example, which is provided with at least one such pivot connection part.

This pivot connection part is intended to be mounted between two mechanical elements having to take two positions, one with respect to the other, over time, namely:

a first fixed position (or initial position); and a second also fixed position (or end position).

This pivot connection part can, for example, be used as an interface between a rudder or a wing of a missile and the body of the missile, for which, the rudder or the wing is located in a fixed, folded position during the storage and the transport of the missile, and is brought into a deployed position after the launch of the missile.

This pivot connection part has to be capable of implementing, both the following main functions:

ensuring a mechanical connection in the initial position;

controlling a movement to an end (or final) position; and ensuring a blocking in the end position.

Mechanical connection elements (or parts) are known, which are intended to ensure these types of functions.

Usually, these mechanical connection elements comprise a plurality of mechanical components. This usual solution has a certain number of disadvantages, and in particular:

it requires a verification of the quality of all of the mechanical components used;

it requires an assembly of all these mechanical components, with a verification of the quality of the assembly obtained; and it requires the functional acceptance of the assembly.

This usual solution therefore requires a significant number of mechanical components, a significant assembly time, as well as a relatively significant control duration.

This usual solution is therefore not completely satisfactory for the applications considered.

Moreover, by document U.S. Pat. No. 6,092,264, a mechanism is known to deploy a member such as an aerofoil or an antenna by pivoting.

The present invention relates to a pivot connection part intended for a flying machine or for a flying machine system, in particular a missile which aims to overcome the abovementioned disadvantages.

According to the invention, said pivot connection part is one piece and comprises:

a first extended body, called inner body, defined with respect to a reference axis;

a second extended body, called outer body, defined with respect to the reference axis, radially surrounding said inner body outwards and arranged coaxially to the latter according to said reference axis;

a set of connection elements producing a continuity of matter between the inner body and the outer body so as to attaching the inner and outer body to each other in a relative (initial) position called fixing position, said connection elements being capable of being broken under the effect of a predetermined force, the breaking of said connection elements detaching the inner and outer bodies from one another, and thus making it possible for a relative rotation between the latter about said reference axis;

a first cam blocking assembly, comprising at least one co-operating cam and one co-operating stop, of which one forms part of the inner body and the other forms part of the outer body, said first blocking assembly being capable of blocking the relative rotation between said inner and outer bodies with respect to a first direction of rotation in a relative (end) position called blocking position between said inner and outer bodies; and a second pawl blocking assembly, comprising at least one co-operating pawl and one co-operating resilient stop blade, of which one forms part of the inner body and the other forms part of the outer body, said second blocking assembly being capable of blocking the relative rotation between said inner and outer bodies with respect to a second direction of rotation opposite said first direction of rotation in said blocking position.

Thus, the connection part is configured to be able to be located in one of the two states:

an initial state, wherein the two inner and outer bodies have an initial relative position (called fixing position), which is maintained by said set of connection elements; and a subsequent end state, wherein the two inner and outer bodies have a relative end position (called blocking position), which is reached following a relative rotation between the inner and outer bodies of said fixing position to said blocking position, after the breaking of the connection elements, and which is maintained by said first and second blocking assemblies.

The connection part initially in said initial state can therefore be brought into the end state, which is final, a return into the initial state no longer being possible.

Thus, thanks to the invention, a one piece (or unitary) part is obtained which is produced, preferably, by an additive type method by adding matter, as specified below.

In addition to being able to carry out the abovementioned functions, this one piece pivot connection part therefore comprises one single part and not a plurality of parts different from the usual abovementioned solutions. Thus, it is not necessary to produce the assembly. In addition, the duration of controlling the part obtained is reduced.

Advantageously, said first blocking assembly comprises, in addition, a guide configured to guide said at least one rotation cam, the cam forming part of one of said inner and outer bodies and the guide forming part of the other of said inner and outer bodies.

In addition, advantageously, said at least one cam is arranged according to a circular arc around a peripheral portion of the inner body of which it forms part, and it has a radial thickness increasing along the circular arc. Preferably, said first blocking assembly comprises at least three pairs of co-operating cams and stops.

In a preferred embodiment, said at least one resilient stop blade of said second blocking assembly is an excrescence in a circular arc linked by a first end to a radially inner face of the outer body and having a second free end, intended to come into contact at least partially with a free end of the co-operating pawl. Preferably, the transversal edge of the free end of the resilient stop blade has a non-zero angle with respect to the transversal edge of the free end of the pawl co-operating during a contact of the two free ends, this angle being acute towards the reference axis.

Moreover, advantageously, said second blocking assembly comprises at least three pairs of co-operating pawls and resilient stop blades.

Moreover, in a specific embodiment, the connection elements are arranged radially with respect to the reference axis and are distributed evenly about this reference axis.

The present invention also relates to a flying machine, in particular a missile, or a flying machine system, in particular a weapon system, which comprises at least one one piece pivot connection part, such as that described above.

The present invention further relates to a method for producing such a one piece pivot connection part, which is noteworthy in that it is of the additive type (or ALM for "Additive Layer Manufacturing"), by adding matter, i.e. that it produces a 3D printing. The one piece pivot connection part, is produced, preferably, made of a metal or plastic material.

Moreover, the present invention also relates to a method for pivoting such a one piece pivot connection part, said method comprising:

- a breaking step consisting of generating a rotation force between the inner and outer bodies of the pivot connection part located in the fixing position representing the initial relative position, so as to break all of the connection elements;
- a rotation step consisting of generating a relative rotation between the inner and outer bodies to bring them from said fixing position into the end relative position; and
- a blocking step consisting of blocking said inner and outer bodies in said end relative position, using said first and second blocking assemblies, simultaneously in both directions of rotation.

The appended figures will show how the invention can be achieved. On these figures, identical references designate similar elements.

Figure 6:
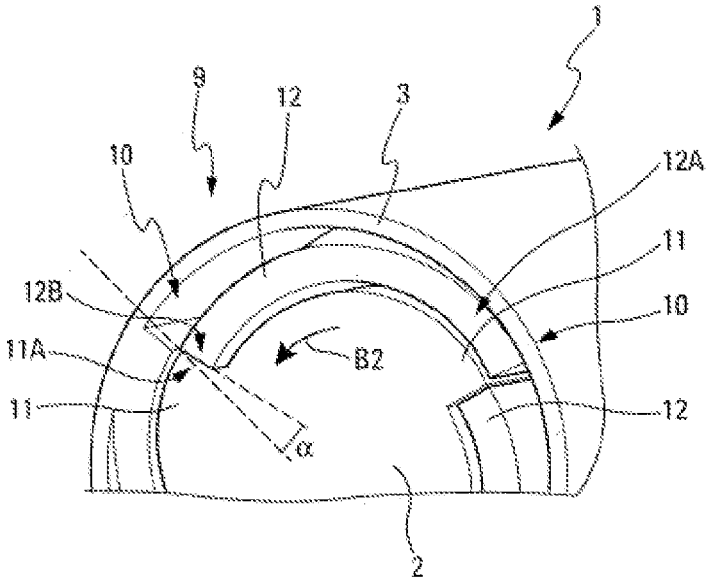

FIG. 6 schematically shows a non-zero angle between the free ends of a co-operating pawl and of a co-operating resilient stop blade.

Figure 1:
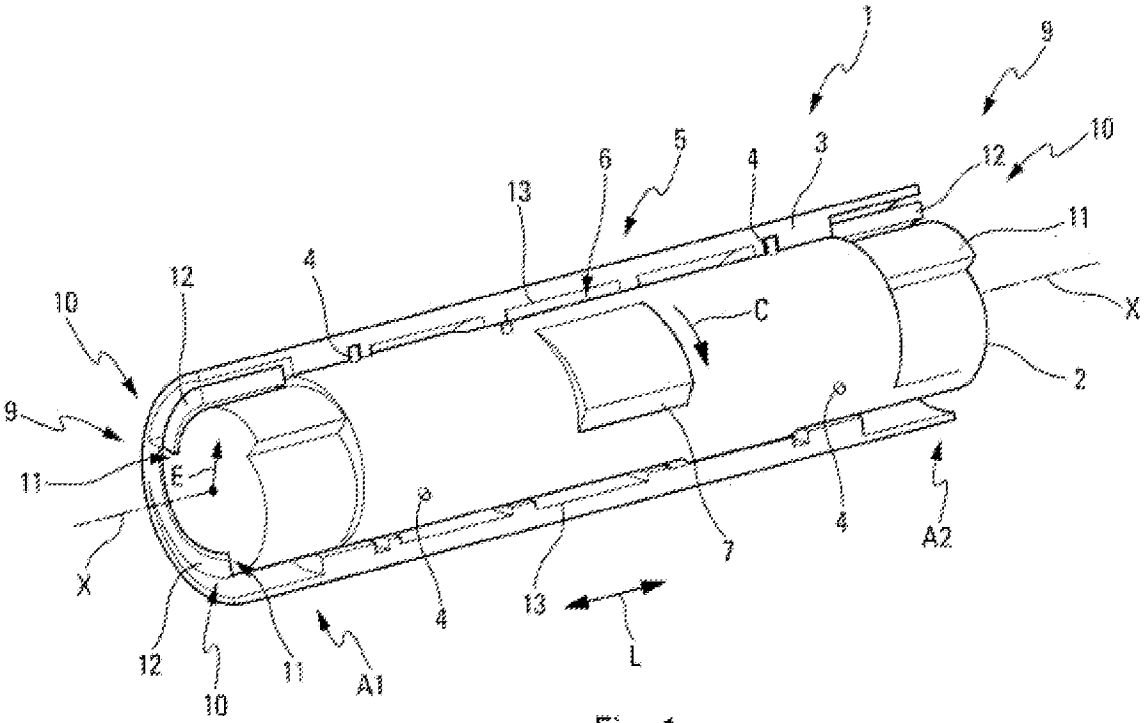
FIG. 1 is a perspective, partially open view, of a pivot connection part.

The part 1 making it possible to illustrate the invention and represented in a specific embodiment in FIG. 1, is a pivot connection part (hereinafter, "part"). This part 1 is intended for a flying machine or for a flying machine system, in particular a missile.

Figure 2:
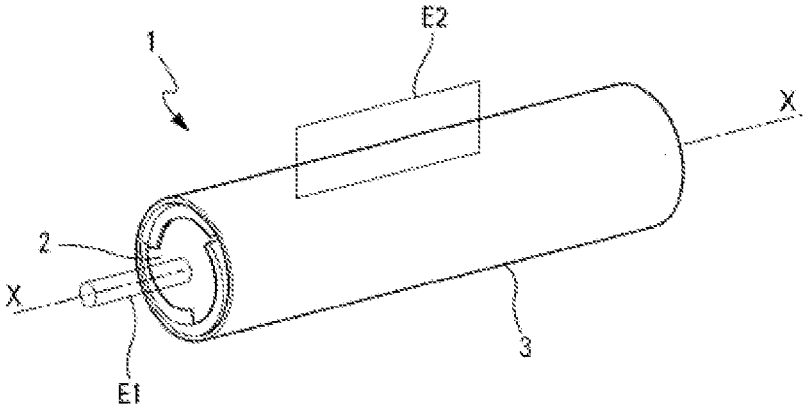
FIG. 2 is a perspective view of the pivot connection part of FIG. 1.

More specifically, this part 1 is intended to be mounted between two (mechanical) elements E1 and E2, represented schematically and as a fine line in FIG. 2. These two elements E1 and E2 must take two positions with respect to one another over time, namely:

- a first position (or initial position) which is fixed; and
- a second position (or end position) which is also fixed.

These elements E1 and E2 can correspond, as an illustration, to on the one hand, a rudder or a wing of a missile or of another flying machine (for example, a drone), and on the other hand, to the body of this missile or of this flying machine. In the case of a missile, the rudder or the wing is located in a fixed folded position (initial position) during the storage and the transport of the missile, and it is brought into a fixed deployed position (end position) after the launch of the missile. The part 1 can also be used as an interface element which is mounted on a weapon system, in particular on a missile launcher, for example to be used as an interface for a missile container carrier or an unlocking arm.

According to the invention, said part 1 is of one piece (or unitary) type, i.e. that it is made of one single element (or part), as specified below.

In addition, according to the invention, said part 1 comprises, as represented in FIG. 1:

- a first body, called inner body 2, which is mainly extended along a reference axis (or longitudinal axis) X-X specified below; and
- a second body, called outer body 3, which is also mainly extended along the reference axis X-X, which radially surrounds, outwards (in the direction illustrated by an arrow E in FIGS. 1 and 3A), the inner body 2 and which is arranged coaxially to the latter about the reference axis X-X.

Figure 3C:
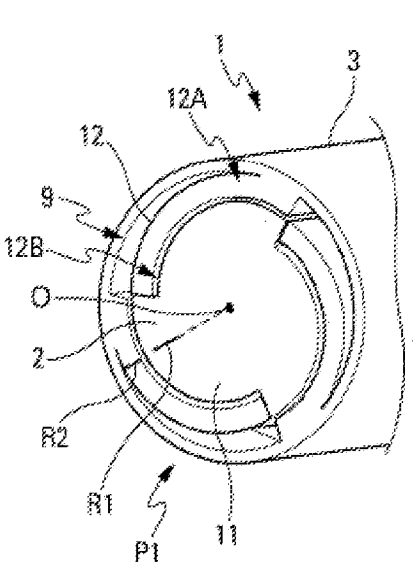
FIGS. 3A, 3B and 3C are schematic views respectively of a set of connection elements, of a cam blocking assembly and a pawl blocking assembly, in an initial relative position between the inner and outer bodies.
Figure 3B:
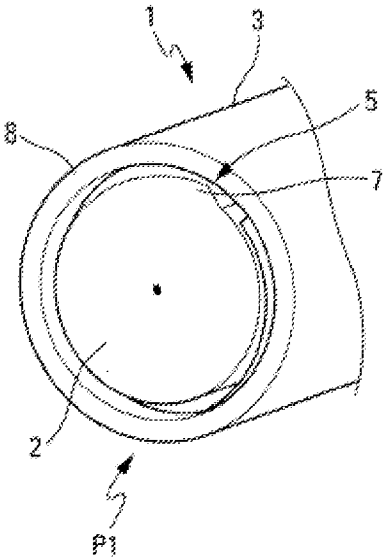
Figure 3A:
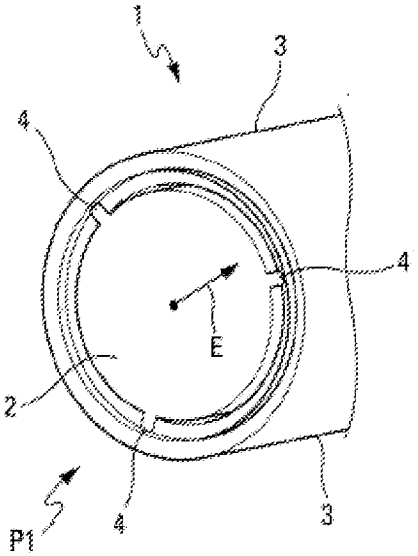

Furthermore, the part 1 also comprises a set of connection elements 4, which can be seen, in particular, in FIG. 3A.

These connection elements 4 (or spacers) correspond to a continuity of matter between the inner body 2 and the outer body 3 so as to attach the inner 2 and outer 3 bodies to one another. These connection elements 4 are made in the form of pins having any transversal cross-section, and for example, circular. The size (and in particular the diameter), as well as the number of connection elements 4 are adapted such that the connection elements 4 have a resistance to the given breaking and that they are broken all together under the effect of a predetermined force. This force is applied to generate a rotation between the inner 2 and outer 3 bodies, as illustrated in FIG. 4A where the inner body 2 is rotated in a direction F with respect to the outer body 3. In this FIG. 4A, the breaking zone of each of the connection elements 4 is shown by a line G.

Figure 4C:
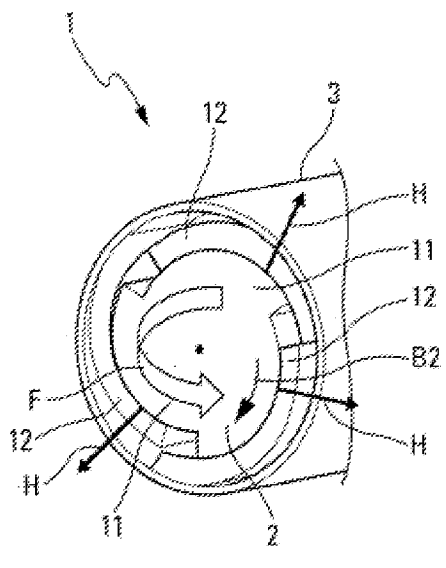
FIGS. 4A, 4B and 4C are schematic views respectively of a set of connection elements, of the cam blocking element and of the pawl blocking element, during a relative rotation between the inner and outer bodies.
Figure 4B:
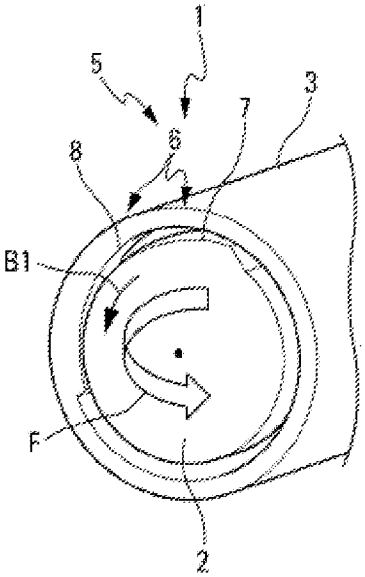
Figure 4A:
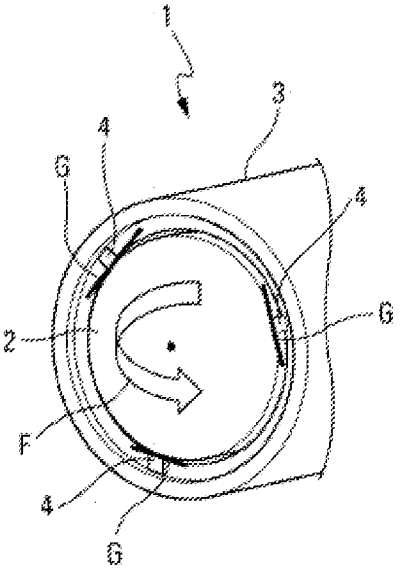

The breaking of all of the connection elements 4 detaches the inner 2 and outer 3 bodies from one another and thus makes it possible for a relative rotation between the inner 2 and outer 3 bodies about the reference axis X-X, as illustrated by the arrow F in FIGS. 4A, 4B and 4C.

The inner body 2 and the outer body 3 are linked together only by way of these connection elements 4 in an initial relative position called fixing position P1, specified below, as represented in FIG. 3A.

In the scope of the present invention:

- "relative rotation" between the inner body 2 and the outer body 3, means a rotation on the one hand with respect to the other about the reference axis X-X, this rotation could be obtained:
  - by a (rotation) action generated (by any usual means) on the inner body 2 such that this inner body 2 rotates about the reference axis X-X, while the outer body 3 remains immobile, as in the example of FIGS. 4A, 4B and 4C (arrow F); or
  - by a (rotation) action generated (by any usual means) on the outer body 3 such that this outer body 3 rotates about the reference axis X-X, while the inner body 2 remains immobile; or by rotation actions generated simultaneously on the two inner 2 and outer 3 bodies;

"relative position" between the inner body 2 and the outer body 3, means a given angular position between these two inner 2 and outer 3 bodies, one with respect to the other, about the reference axis X-X, as specified below.

Moreover, the part 1 also comprises a cam blocking assembly 5. This blocking assembly 5 comprises at least one pair 6, but preferably a plurality of pairs 6 formed, each, of a co-operating cam 7 and of a co-operating stop 8, as represented in particular in FIGS. 4B and 5B.

The cam 7 is an element having a shape, itself making it possible to be moved, and to be blocked when it is in a blocking contact with the co-operating stop 8.

One of these two elements (cam 7 or stop 8) forms part of the inner body 2 and the other of these two elements (cam 7 or stop 8) forms part of the outer body 3.

In the preferred embodiment, represented in the figures, for each pair 6, the cam 7 forms part of the inner body 2 and the stop 8 forms part of the outer body 3. In an embodiment variant not represented, the cam 7 can form part of the outer body 3 and the stop 8 can form part of the inner body 2.

Figure 5C:
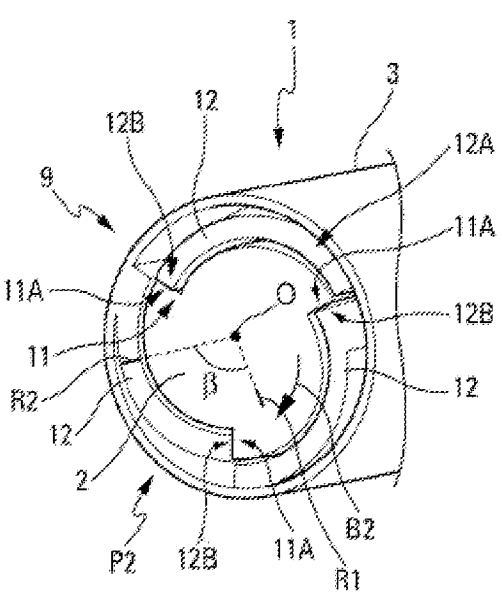
FIGS. 5A, 5B and 5C are schematic views, respectively of the set of connection elements, of the cam blocking assembly and of the pawl blocking assembly, in an end relative position between the inner and outer bodies.
Figure 5B:
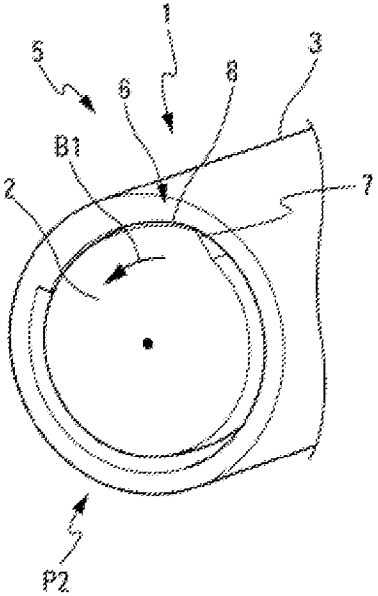

This blocking assembly 5 is capable of blocking the relative rotation between said inner 2 and outer 3 bodies with respect to a first direction of rotation of the inner body 2 with respect to the outer body 3, illustrated by the arrow B1 in FIGS. 4B and 5B. The blocking assembly 5 is configured such that this blocking is obtained for a relative position called blocking position P2 between said inner 2 and outer 3 bodies.

Furthermore, the part 1 also comprises a second pawl blocking assembly 9. This blocking assembly 9 comprises, as represented in FIG. 1, at least one pair 10, but preferably, a plurality of pairs 10 formed, each, of a co-operating pawl 11 and a co-operating resilient stop blade 12. The pawl 11 corresponds to an element in the form of a ratchet which is capable of being blocked in rotation by an end of the resilient stop blade 12.

For each pair 10, one of the elements (pawl 11 or resilient stop blade 12) forms part of the inner body 2 and the other of these elements (pawl 11 or resilient stop blade 12) forms part of the outer body 3.

In the preferred embodiment, represented in the figures, for each pair 10, the pawl 11 forms part of the inner body 2 and the resilient stop blade 12 forms part of the outer body 3. In an embodiment variant not represented, the pawl 11 can form part of the outer body 3 and the resilient stop blade 12 can form part of the inner body 2.

This blocking assembly 9 is capable of blocking the relative rotation between the inner 2 and outer 3 bodies with respect to a second direction of rotation (of the inner body 2 with respect to the outer body 3). This second direction of rotation which is opposite said first direction of rotation B1, is illustrated by the arrows B2 in FIGS. 4C and 5C. The blocking assembly 9 is configured such that this blocking is obtained also when the inner 2 and outer 3 bodies are located in a relative position corresponding to the blocking position P2.

Thus, the connection part 1 is configured to be able to be located in one of the two states:

an initial state, wherein the two inner 2 and outer 3 bodies have the (relative) fixing position P1 represented in FIGS. 3A, 3B and 3C, which is maintained by the connection elements 4; and a subsequent end state, wherein the two inner 2 and outer 3 bodies have the (relative) blocking position P2 (represented on FIGS. 5A, 5B and 5C), which is obtained following a relative rotation between the inner 2 and outer 3 bodies of the fixing position P1 to the blocking position P2 after the breaking of the connection elements 4 and which is maintained by the blocking assemblies 5 and 9, each preventing the rotation in a direction B1, B2.

More specifically, as an illustration:

in the (relative) initial position P1 between the inner body 2 and the outer body 3, a given reference line R1 of the inner body 2 is located angularly at the level of a given reference line R2 of the inner body 3, i.e. that the two reference lines R1 and R2 are aligned radially, as illustrated in FIG. 3C;

however, in the (relative) end position P2, the inner 2 and outer 3 bodies have rotated one with respect to the other, such that the reference lines R1 and R2 form a (non-zero) angle β with respect to the centre O (where the reference axis X-X passes through), as illustrated in FIG. 5C.

The connection part 1, initially in the initial state (fixing position P1), can thus be brought (irreversibly) into the end state (blocking position P2) which is final, a return into the initial state no longer being possible from the end state. The part 1 is therefore configured to make it possible for one sole and single movement from the initial position P1 to the end position P2.

Of course, the blocking assemblies 5 and 9 are configured by a number and a suitable positioning of the pairs 6 and 10, so that the two blockings (according to B1 and B2) occur simultaneously for the same relative (blocking) position.

In the example represented on FIGS. 1 and 2, the outer body 2 is globally cylindrical and the outer body 3 corresponds to a mainly cylindrical casing surrounding the inner body 2. The reference axis X-X is the common longitudinal axis of this cylinder and of this cylindrical casing.

In an embodiment variant (not represented), the inner body 2, instead of being mainly cylindrical, can comprise only of the cylindrical longitudinal sections at the level of which are arranged the pairs 6 and the pairs 10, these cylindrical sections being linked together in any manner, for example by non-cylindrical, or cylindrical longitudinal sections, but with a smaller diameter.

Moreover, the blocking assembly 5 comprises, in addition, as represented in FIG. 1, associated with each cam 7, a guide 13. Each guide 13 is configured to guide the cam 7 associated in rotation, i.e. to avoid a longitudinal movement (illustrated by a double arrow L) of the inner body 2 with respect to the outer body 3. The cam 7 forms part of one of said inner body 2 and outer body 3, preferably of the inner body 2, and the guide 13 forms part of the other of said inner 2 and outer 3 bodies.

Preferably, each guide 13 comprises a recess made in the inner face of the outer body 3, which has a length (parallel to the axis X-X) and a thickness (radially to the axis X-X) slightly greater than the corresponding dimensions of the associated cam 7, to make it possible for the passage of the cam 7 in the recess by preventing a longitudinal movement.

Moreover, each cam 7 is arranged according to a circular arc around a peripheral portion of the inner body 2, of which it forms part, and it has a radial thickness increasing along the circular arc in the direction illustrated by an arrow C in FIG. 1.

Moreover, in a preferred embodiment, each (flexible) resilient stop blade 12 of the blocking assembly 10 is a circular arched excrescence. This circular arched excrescence is linked by a first end 12A and a radially inner face of the outer body 3 and has a second end 12B which is free, as represented in particular in FIGS. 3C and 5C. The free end 12B is intended to come into contact, at least partially, a free end 11A of the pawl 11 co-operating during a putting into contact of the two free ends 11A and 12B, as represented in FIGS. 5C and 6.

Preferably, the transversal edge of the free end 12B of the resilient stop blade 12 has a non-zero angle α with respect to the transversal edge of the free end 11A of the co-operating pawl 11, as represented in FIG. 6. This angle α is acute towards the reference axis X-X. It makes it possible to facilitate the blocking.

Although the part 1 can fulfil the functions thereof with one single pair 6 and one single pair 10, the part 1 comprises, preferably, a plurality of pairs 6 and 10 distributed evenly (from an angular standpoint) about the reference axis X-X.

In a preferred embodiment, making it possible to benefit from a good rotational stability:

- the blocking assembly 5 comprises three co-operating cam and co-operating stop pairs 6; and
- the blocking assembly 9 comprises three co-operating pawl and resilient stop blade pairs 10.

However, as a function, in particular of the considered angle β of relative rotation between the inner 2 and outer 3 bodies to pass from the initial position P1 to the end position P2, a different number of pairs 6 and 10 can be provided, and in particular, a number greater than three, if the angle of rotation 13 is reduced.

Moreover, in a preferred embodiment, the connection elements 4 are arranged radially with respect to the reference axis X-X and are distributed evenly about this reference axis X-X.

In a preferred embodiment, represented in FIG. 1, the part 1 comprises:

- two blocking assemblies 9 (with three pairs 10) arranged, respectively, longitudinally towards each longitudinal end A1 and A2 (i.e. about the reference axis X-X) of the part 1;
- one single blocking assembly 5 (with three pairs 6) arranged longitudinally substantially at the middle of the part 1; and
- two sets of connection elements 4 arranged, respectively, longitudinally towards each longitudinal end A1 and A2, at each time between a blocking assembly 9 and the blocking assembly 5.

The part 1, such as described above, is capable of implementing, both, the following main functions:

- ensuring the mechanical connection in the initial (fixing) position P1, using connection elements 4;
- controlling the movement from the initial position P1 to the end position P2, using in particular, cams 7 and associated guides 13; and
- ensuring the blocking in the end position P2, using blocking assemblies 5 and 9.

This part 1 is of the one piece type. Thus, it is not necessary to produce an assembly of mechanical components. In addition, the duration for controlling the part 1 is reduced.

This one piece part 1 is manufactured, preferably, by a usual additive type manufacturing method (or ALM—"Additive Layer Manufacturing") by adding matter, i.e. by a 3D printing. The part 1 is made, preferably, of a metal or plastic structural material. The connection elements 4, in addition to their mechanical connection function in the initial position P1, make it possible to facilitate the 3D printing by ensuring, in particular, a maintaining of the inner body with respect to the outer body during printing.

The functioning of the part 1, such as described above, is presented below using a method for pivoting said one piece pivot connection part 1.

This method is implemented on a part 1 located in an initial state (or fixing position P1 between the bodies 2 and 3), as represented in FIGS. 3A, 3B and 3C showing respectively the connection elements 4 (which ensure the connection between the two bodies 2 and 3), the blocking assembly 5 (for which the cams 7 are not in contact with the associated stops 8) and the blocking assembly 9 (for which no force is applied on the resilient stop blades 12).

Figure 5A:
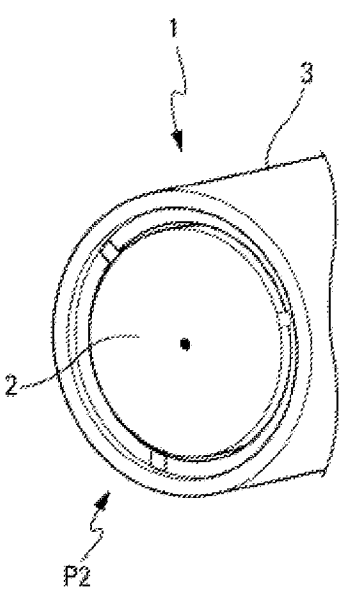

Said method comprises:

- a breaking step consisting of generating a rotation force, illustrated by the arrow F on FIGS. 4A, 4B and 4C, between the inner body 2 and the outer body 3 of the part 1 located in the fixing position P1, so as to break the connection elements 4 (FIG. 4A);
- a rotation step consisting of generating a relative rotation between the inner body 2 and the outer body 3, illustrated by the arrow F in FIGS. 4A, 4B and 4C, to bring them from the fixing position P1 (FIGS. 3A, 3B and 3C) into the end position P2 (FIGS. 5A, 5B and 5C). During the rotation, the pawls 11 push the resilient stop blades 12 substantially radially outwards, as shown by the arrows H in FIG. 4C; and
- a blocking step consisting of blocking said inner 2 and outer 3 bodies in said end position P2 using said blocking assemblies 5 and 9, as represented in FIGS. 5B and 5C.

In the example represented, the blocking assembly 5 blocks and prevents the rotation of the inner body 2 (with respect to the outer body 3) in the direction B1, as shown on FIG. 5B, and simultaneously the blocking assembly 9 blocks and prevents the rotation of the inner body 2 (with respect to the outer body 3) in the direction B2 (opposite B1), as shown on FIG. 5C. Consequently, the inner body 2 cannot rotate according to B1, nor according to B2 with respect to the outer body 3. It is therefore completely blocked and the end position P2 is fixed.

The invention claimed is:

1. A pivot connection part configured to form an interface between a body and a wing of a flying machine, the pivot connection part comprising:

- an inner body defined with respect to a reference axis;
- an outer body defined with respect to the reference axis, radially surrounding the inner body, and arranged coaxially to the inner body with the reference axis;
- a set of connection elements configured to attach the inner body and the outer body together in a fixing position, and being configured to be broken by a predetermined force such that the inner body and the outer body can rotate relative to one another about the reference axis;
- a cam blocking assembly comprising a cooperating cam and a cooperating stop, of which one of the cooperating cam and the cooperating stop forms part of the inner body and the other of the cooperating cam and the cooperating stop forms part of the outer body, the cam blocking assembly being configured to block relative rotation between the inner body and the outer body with respect to a first direction of rotation in a blocking position between the inner and outer bodies; and
- a pawl blocking assembly comprising a cooperating pawl and a cooperating resilient stop blade, of which one of the cooperating pawl and the cooperating resilient stop blade forms part of the inner body and the other of the cooperating pawl and the cooperating resilient stop blade forms part of the outer body, the pawl blocking assembly being configured to block relative rotation between the inner body and outer body with respect to a second direction of rotation that is opposite the first direction of rotation in the blocking position.

2. The pivot connection part according to claim 1, wherein the cam blocking assembly comprises a guide configured to guide the cam in rotation, the cam forming part of one of the inner and outer bodies and the guide forming part of the other of the inner and outer bodies.

3. The pivot connection part according to claim 1, wherein the cam is arranged according to a circular arc around a peripheral portion of the inner body of which it forms part, and the cam has a radial thickness increasing along the circular arc.

4. The pivot connection part according to claim 1, wherein the cam blocking assembly comprises at least three pairs of co-operating cams and stops.

5. The pivot connection part according to claim 1, wherein the pawl blocking assembly comprises at least three pairs of co-operating pawls and resilient stop blades.

6. The pivot connection part according to claim 1, wherein the at least one resilient stop blade of the pawl blocking assembly is a circular arched excrescence linked by a first end to a radially inner face of the outer body and having a free end configured to come into contact at least partially with a free end of the co-operating pawl.

7. The pivot connection part according to claim 6, wherein a transversal edge of the free end of the resilient stop blade has a non-zero angle ($\alpha$) with respect to a transversal edge of the free end of the co-operating pawl during a contact of the two free ends, the angle ($\alpha$) being acute towards the reference axis.

8. The pivot connection part according to claim 1, wherein the connection elements are arranged radially with respect to the reference axis and are distributed evenly around this reference axis.

9. The pivot connection part according to claim 1, wherein the pivot connection part is made of a metal or a plastic material.

10. The pivot connection part of claim 1, wherein the pivot connection part forms the interface between the body and the wing of the flying machine.

11. A flying machine system comprising a pivot connection part, the pivot connection part comprising:

an inner body defined with respect to a reference axis;

an outer body defined with respect to the reference axis, radially surrounding the inner body, and arranged coaxially to the inner body with the reference axis;

a set of connection elements configured to attach the inner body and the outer body together in a fixing position, and being configured to be broken by a predetermined force such that the inner body and the outer body can rotate relative to one another about the reference axis;

a cam blocking assembly comprising a cooperating cam and a cooperating stop, of which one of the cooperating cam and the cooperating stop forms part of the inner body and the other of the cooperating cam and the cooperating stop forms part of the outer body, the cam blocking assembly being configured to block relative rotation between the inner body and the outer body with respect to a first direction of rotation in a blocking position between the inner and outer bodies; and a pawl blocking assembly comprising a cooperating pawl and a cooperating resilient stop blade, of which one of the cooperating pawl and the cooperating resilient stop blade forms part of the inner body and the other of the cooperating pawl and the cooperating resilient stop blade forms part of the outer body, the pawl blocking assembly being configured to block relative rotation between the inner body and outer body with respect to a second direction of rotation that is opposite the first direction of rotation in the blocking position, wherein the pivot connection part forms an interface between the body and a wing of a flying machine.

12. A method of pivoting a one piece pivot connection part for a flying machine, the one piece pivot connection part forming an interface between a wing and body of the flying machine, having an inner body defined with respect to a reference axis, an outer body defined with respect to the reference axis, radially surrounding the inner body, and coaxially surrounding the inner body about the reference axis, a set of connection elements attaching the inner body to the outer body in a fixing position, a cam blocking assembly, and a pawl blocking assembly, the method comprising:

breaking all of the connection elements by generating a rotation force between the inner and outer bodies of the pivot connection part in the fixing position;

bringing the inner body and outer body into an end relative position by generating a relative rotation between the inner and outer bodies; and blocking the inner and outer bodies in the end relative position, using the cam blocking assembly and the pawl blocking assembly, simultaneously in two directions of rotation.

* * * * *